US008720155B1

(12) United States Patent
Robell

(10) Patent No.: US 8,720,155 B1
(45) Date of Patent: May 13, 2014

(54) METHOD AND SYSTEM OF FRAMING COMPONENTS AND HANGERS USED IN A STRUCTURAL INTERFACE

(76) Inventor: Glenn Robell, Fallbrook, CA (US)

( * ) Notice: Subject to any disclaimer, the term of this patent is extended or adjusted under 35 U.S.C. 154(b) by 158 days.

(21) Appl. No.: 12/604,416

(22) Filed: Oct. 23, 2009

(51) Int. Cl.
*E04B 1/38* (2006.01)
*E04C 5/00* (2006.01)

(52) U.S. Cl.
USPC ..... 52/702; 52/482; 52/767; 52/489.1; 52/483.1; 52/655.1; 52/781; 52/781.3; 52/289; 52/712; 52/715

(58) Field of Classification Search
USPC ..... 52/489.1, 584.1, 586.1, 163, 778, 52/483.1, 282.4, 300, 236.9, 655.1, 779, 52/780, 781, 781.3, 702, 289, 712, 715, 52/482, 767; 403/232.1, 403
See application file for complete search history.

(56) References Cited

U.S. PATENT DOCUMENTS 3,907,445 A * 9/1975 Wendt ..... 403/191
3,945,741 A * 3/1976 Wendt ..... 403/191
4,423,977 A * 1/1984 Gilb ..... 403/232.1
4,480,941 A * 11/1984 Gilb et al. ..... 403/232.1
4,893,961 A * 1/1990 O'Sullivan et al. ..... 403/232.1
5,004,369 A * 4/1991 Young ..... 403/232.1
5,217,317 A * 6/1993 Young ..... 403/232.1
5,564,248 A * 10/1996 Callies ..... 52/702
5,603,580 A * 2/1997 Leek et al. ..... 403/232.1
6,523,321 B1 * 2/2003 Leek et al. ..... 52/702
6,877,291 B2 * 4/2005 Shamroukh et al. ..... 52/702
6,942,132 B2 * 9/2005 Oetlinger ..... 225/104
7,334,372 B2 * 2/2008 Evans et al. ..... 52/289
8,250,827 B2 * 8/2012 Lin et al. ..... 52/702

* cited by examiner

*Primary Examiner* — Chi Q Nguyen
(74) *Attorney, Agent, or Firm* — Dorothy S. Morse

(57) ABSTRACT

A system and method used in residential and commercial construction of floors, ceilings and roofs, where a beam and hanger together support a joist/rafter to which sheathing is applied. Hanger design features include bendable stiffeners that provide pinching structural support for opposing sides of an engineered wood I-joist web after the joist/rafter is seated into the bridge of the hanger, providing a superior structural interface connection, less material cost, and no contact between the hanger and sheathing which reduces unwanted noise in finished construction. Additional strengthening of the structural/load-bearing interface between the joist/rafter and beam may include selected horizontally-extending dato, groove, cut, or other detail formed in the support beams during their manufacture/milling and rearwardly-extending protections on the hanger configured to engage the detail.

20 Claims, 8 Drawing Sheets

METHOD AND SYSTEM OF FRAMING COMPONENTS AND HANGERS USED IN A STRUCTURAL INTERFACE

CROSS-REFERENCES TO RELATED APPLICATIONS

This U.S. utility patent application relates to the previously filed and still pending U.S. provisional patent application filed by the same inventor herein and having the title of System and Method of Interlocking Framing Connectors into Engineered Wood Framing Components and Solid Sawn Lumber, the application number of 61/227,770, and a filing date of 22 Jul. 2009. As a result, domestic priority based upon this above-mentioned U.S. provisional patent application is requested for the new U.S. utility patent application now being filed.

BACKGROUND

1. Field of the Invention

This invention relates to the field of wood framing products and methods of their connection in structural interfaces using hangers, specifically to a system and method of providing supporting beams and supported joists/rafters for use in a load-bearing structural interface upon which sheathing is eventually secured, in combination with a hanger that does not need to be supported by the top surface of the beam, but instead can engage structure/detail formed into the beam during its manufacture, milling, and/or off-site cutting to size, and comprises one or more bendable stiffener components (optionally separable in part from the remainder of the hanger) that enhance the stability of the supported joist/rafter by significantly reducing the possibility of any potential rotation relative to the beam. Furthermore, mounting the present invention hanger below the top surface of the beam reduces unwanted noise in the finished construction, reduces material cost in floor, ceiling, and roof construction, and can also provide labor and/or cost savings during hanger installation. The structure/detail in a present invention beam can be in one or more sides/edges of a supporting beam, and a portion of the hanger may be inserted into beam straight in (or at an angle), with the structure/detail provided in the beam being in the form of one or more datos, grooves, cuts, cut-outs, and/or indentations. The depth of the structure/detail may vary, as can the depth to which the hanger is inserted into the structure/detail. However, it is not contemplated for the structure/detail in the beam to be so deep so as to diminish the strength and/or structural integrity of the beam, or for the widths dimension of the pre-formed indentation or indentations in the beam to be excessively large when compared to the thickness dimension of the hanger material contemplated for insertion into it, so as to provide easy hanger installation within the indentation while at the same time limiting the amount of space available therein for hanger movement. The framing components used as a part of the present invention may include EWP (Engineered Wood Products) and solid sawn lumber, and in addition to use of solid sawn lumber, as a present invention supporting beam in floor, ceiling, and roof applications, beams may also include, but are not limited to, Glulam beams and those comprising LVL (laminated veneer lumber), PSL (parallel strand lumber), and LSL (laminated strand lumber). The structure/detail cut into present invention beams provides rapid hanger layout and positioning, as well as a strong interlocking connection between a present invention hanger and its supporting beam, enabling a structural interface to carry specific load requirements with smaller hangers that may also be employed with fewer fasteners (unless otherwise dictated by local building code), all of which contribute to the reduction of material and tabor cost in the finished construction. The use of bendable stiffeners to stabilize the thin central web of an engineered wood joist/rafter may also allow a smaller hanger to carry a specified load requirement. For time savings on a job site it is contemplated (but not critical) for present invention hangers to be pre-scored and/or pre-cut for easier and faster bending by an installer so that in a first position the wide flange/base of an engineered wood joist/rafter can be easily lowered into and seated within the hanger's bridge, after which the bendable web stiffeners of the present invention hanger are moved against opposing sides of the central web of the seated joist/rafter for added reinforcement of joist/rafter and to stabilize it so as to avoid the possibility of any potential rotation relative to a supporting beam. The edges of the bendable web stiffeners of a present invention hanger may also be reinforced, or not, and/or have one or more installation-facilitating tap points. Furthermore, since the datos/grooves/cuts/cutouts/indentations (hereinafter simply "indentations" without any intent of limitation) of the present invention are made via automated-feed equipment in a saw line, as part of a milling operation, or at an off-site location where lumber is cut to size, one or more indentations can be precisely made according to need, made straight into a framing member for horizontal insertion of the bent top edge or another portion of a present invention hanger, angled so that weight/load transfer across supported framing member causes an inserted hanger to remain tightly secured in its position of use (instead of causing a hanger's fasteners to become loosened as a result of the shearing forces created by the weight/load transfer), made at differing widths, lengths, and depths, according to need, made as one elongated indentation extending the full length of the framing component, and/or made as multiple indentations arranged in varying patterns according to application need. It is contemplated for the present invention system and method to be used in both residential and commercial construction applications. Furthermore, present invention hangers are preferably made from metal, and may also be formed with a bent or shaped portion having a configuration complementary to the pre-formed dato, groove, cut, cutout, and/or indentation created in the supporting beams during their manufacture, milting, or cutting to size prior to delivery to a worksite. Thus, present invention use significantly strengthens the structural interface in which it is used above that provided by prior art face-mounted hangers that are simply nailed into a supporting beam, and also has the advantage of avoiding the unwanted noise in the finished construction that is typically experienced when prior art top-mounted hangers are used.

2. Description of the Related Art

In today's construction, whether using framing components made from EWP or solid sawn lumber, hangers and nails are typically installed on-site in floor, ceiling, and roof construction to connect structural framing components in load-bearing structural interfaces. However, at least three important disadvantages occur when traditional metal hangers are used. A first disadvantage is that hanger layout and installation are often labor intensive, which increases construction cost. The second disadvantage is that the design of prior art face-mounted hangers allows them to receive all of their strength from the fasteners/nails used to secure them to the framing components (which could, loosen over time as a result of sheering forces caused by weight/load transfer over a finished floor and/or the influence of strong/gale force winds against a roof). The third disadvantage is that when prior art hangers are secured in part to the top of a supporting beam in a structural interface, unwanted noise in the finished construction typically occurs as a result of hanger and/or fastener contact with sheathing placed over the joists/rafters. Furthermore, there is the potential for inconsistent hanger installation when prior art hangers are employed (particularly face-mounted hangers), whereby if a hanger is not given optimal positioning and/or too few fasteners are used to secure it to a framing component (particularly a beam), maximum sheer and strength in the finished connection between the hanger and the framing component is not achieved, (and may result in the structural interface not meeting needed load requirements). To overcome these disadvantages, the present invention comprises a method and system for providing framing components with optional structure/detail pre-formed in at least one of its sides/edges and hangers configured to be used with such structure/detail, with the framing components including, but not limited to, Glulam beams and those comprising LVL (laminated veneer lumber), PSL (parallel strand lumber), and LSL (laminated strand lumber), as well as solid sawn lumber, that are used within a load-bearing structural interface in residential and commercial construction. A portion of each hanger may be inserted into the structure/detail of the beam supporting it, and/or one or more bendable stiffening components reduce the possibility of any potential rotation of the supported joist/rafter relative to the beam, wherein after the wide flange/base of an engineered wood joist/rafter can be easily lowered into and seated within the hanger's bridge, the bendable web stiffeners of the present invention hanger are moved against opposing sides of the central web of the seated joist/rafter for added reinforcement of joist/rafter and to stabilize it so as to avoid the possibility of any potential rotation relative to a supporting beam. The structure/detail used in the present invention is in the form of at least one pre-formed dato, groove, cut, cut-out, and/or indentation in at least one side/edge of each wood beam that allows partial insertion therein of at least one part of a present invention hanger, so that when two framing components are joined together in a structural interface, an interlocking configuration can be created that provides a significantly stronger and substantially less noisy connection (as its hangers will not be in contact with sheathing secured over the joists/rafters). Also, since the present invention indentations are made by automated means for use with a specific size and shape of hanger, the present invention hangers used to install joists/rafters allow them to become positioned precisely at the needed height for instantaneous leveling of adjacent joists/rafters, as well as instantaneous leveling of joists/rafters relative to the beams supporting each of its opposing ends, reducing unevenness in the finished floors in which they are used. Connection of hangers to the bottom edge of a beam is contemplated as an option in the present invention (but not to the beam's top edge where it could contact sheathing and be a potential source of unwanted noise in finished construction). The pre-formed indentations that are created by automated-feed equipment in the present invention can be continuous or in the form of various patterns to assist in the layout of the metal hangers No method or system is known that provides all of the advantages of the present invention system and method relating to EWP I-Joists and solid sawn lumber framing components, or the hangers that are also disclosed herein.

BRIEF SUMMARY OF THE INVENTION

The primary object of this invention is to provide a system and method for creating a stronger connection between a wood framing component and the hangers intended for supporting rafters/joists in a load-bearing structural interface in the residential and commercial construction of floors, ceilings, and roofs, which may create an interlocking configuration between hanger and beam. It is also an object of this invention to provide a system and method wherein strengthening occurs as a result of at least one portion of the hanger being inserted beyond the exterior surface of its supporting beam and into the structure/detail formed therein, and/or the hanger having one or more bendable stiffening components used for stabilization of the joist/rafter against the possibility of any potential rotation relative to its supporting beam. A further object of this invention is to provide structure/detail in supporting beams used in a load-bearing structural interface, wherein weight/load transfer across the structural interface works to make the connection of hanger and beam more secure, instead of simply causing fasteners to become loosened over time which eventually could lead to a weakened structural interface. It is also an object of this invention to provide a stronger connection between framing components and hangers by use of smaller hangers and/or fewer fasteners so that material and labor costs are reduced. A further object of this invention is to provide datos, grooves, cuts, cut-outs, and/or indentations that in a supporting beam in a load-bearing structural interface are pre-formed offsite and allow precise positioning of a hanger in a location below the sheathing line, so that no portion of the hanger or the fasteners securing it to the beam, is in contact with the sheathing secured to the top of the beam, thus avoiding a likely source of unwanted noise in the finished construction. A further object of this invention is to provide present invention hangers that install joists/rafters that allow the joists/rafters to become positioned precisely at the needed height for instantaneous leveling of adjacent joists/rafters as they are secured in place, as well as instantaneous leveling of joists/rafters to the beams supporting each one of its opposing ends, saving time and reducing unevenness in the finished floors in which they are used. Another object of this invention is to create web stiffeners and/or interlocking configurations between framing components and hangers in a load-bearing structural interface via automated-feed equipment prior to delivery of the framing components to a worksite, so that a precise and minimal amount of material is removed from supporting beams without interfering with their strength and/or structural integrity. It is also an object of this invention to provide a hanger with one or more bendable web stiffeners that allow hanger installation with a custom fit against the thin web of a supported engineered wood joist/rafter used in a load-bearing structural interface, for enhanced stabilization of the joist/rafter against the possibility of any potential rotation relative to the supporting beam.

The present invention comprises a system and method of providing structure/detail on at least one side/edge of framing components intended for connection to one another in a structural interface via metal hangers, wherein the structure/detail can be pre-formed into the framing component by automated-feed equipment before the framing component is delivered to a worksite so that the pre-formed structure/detail is precisely positioned and provides a complementary configuration used for the partial insertion of one or more hangers through the exterior surface of at least one framing component (preferably the one having the supporting function in the structural interface) that creates an interlocking arrangement between hangers and the framing components attached to them to provide superior strength (over prior art face-mounted hangers) in the structural interface to allow it to carry specific load requirements while using smaller hangers and perhaps fewer fasteners/nails if so permitted by local building code. In addition to providing support for a joist/rafter, the present invention hangers install the joist/rafter precisely at the needed height for leveling relative to the supporting beams (and one another) that reduces unevenness in finished floors, an advantage over prior art face-mounted hangers. Present invention hangers also have one or more bendable web stiffeners that in a first position allows its bridge to receive the wide flange/base of an engineered wood joist/rafter, after which one or more bendable portions of the hanger are moved into a position against opposing sides of the central web of the engineered wood joist/rafter to provide it with strong support against the possibility of any potential rotation relative to its supporting beam. Although not limited thereto, the pre-formed structure/detail in the supporting beams preferably comprises one or more datos, grooves, cuts, cut-outs, and/or indentations created by automated-feed equipment when the framing components, such as but not limited to Glulam beams and those comprising LVL (laminated veneer lumber), PSL (parallel strand lumber), and LSL (laminated strand lumber), as well as solid sawn lumber, are manufactured, milled, and/or cut to size, prior to their shipment/delivery to a job site. The cost of creating the interlocking arrangement between framing components and hangers in the present invention is small, when compared to the benefit provided. Furthermore, the pre-formed structure/detail made in a present invention supporting beam used in floor, ceiling, and roof construction, and employed for insertion of one or more bent edges, folded portion, flanges, and/or ribs of an adjoining present invention hanger, can be made in a wide variety of configurations. Removal of the minimum amount of wood from a supporting beam to create a pre-formed indentation is preferred in almost all applications so that beam strength and structural integrity are not compromised. Minimal wood removal is also preferred since it makes the height dimension of the pre-formed indentation or indentations in the beam only slightly larger than the thickness dimension of the hanger material contemplated for insertion into it, to provide easy hanger installation by a framer the indentation, while at the same time limiting the amount of space available therein for hanger movement.

An important benefit of using the present invention system and method (a result of its hanger that becomes partially inserted into a supporting beam in a location below the beam's sheathing line, and/or its bendable web stiffening) is that smaller sized hangers can be employed to provide comparable structural interface strength to that of prior art top-mounted hangers. The reduction in material and shipping weight realized by present invention use further provides cost reduction to the builder, and less burden on the environment. Furthermore, if smaller hangers are used that become connected to a beam below its sheathing line (and as a result have no engagement with the top surface of a supporting beam), when hanger installation is complete no hanger material or metal fasteners will be present on top of the beam to rub against sheathing subsequently secured on top of the beam and joists/rafters, reducing unwanted noise in the finished construction. In addition, a fast and easy way to reduce the possibility of any potential rotation of a supported joist/rafter relative to its supporting beam is also provided by the present invention disclosure herein. A further benefit derived from use of the pre-formed structure/detail applied by automated means to present invention supporting beams is that the present invention hangers used to install joists/rafters allow them to become positioned precisely at the needed height for instantaneous leveling of adjacent joists/rafters, as well as instantaneous leveling of joists/rafters to the beams supporting each of its opposing ends, reducing unevenness in the finished floors in which they are used. Thus, the present invention may provide complementary structure (bent, angled, or shaped) in hangers and EWP framing components (also in solid sawn lumber framing components) that not only facilitates attachment to one another, but makes their installation faster. Also, greater strength is provided to a structural interface when the present invention is used, as the hanger is affected by less shearing forces as a result of it being partially inserted into the supporting beam. However, use of a hanger with one or more bendable web stiffeners may avoid a need for partial insertion of a hanger into a supporting beam in selected applications. Also, tapping points, reinforced edges, and score lines may be incorporated into the structure of a present invention hanger intended for web stiffening use, to assist an installer in bending a present invention hanger for its secure positioning against the thin central web of an engineered wood joist/rafter and/or one of the two wider flanges depending from the opposing sides of the web. Thus, the present invention system and method may provide an interlocking connection between a hanger and a supporting beam, and/or provide bendable stiffening for the web of a supported joist/rafter to reduce the possibility of any potential rotation relative to the supporting beam (before, during, and after sheathing is attached), while subjected to sheering forces associated with weight/load transfer across the joists/rafters. In addition, another advantage of the present invention is that it may allow the use of smaller hangers, and require less labor cost during installation. The cost of creating the structure/detail in EWP framing components of the present invention is small when considering the value it provides in a structural interface, as well as the material and labor savings to the end user (which also realizes an environmental benefit). It is preferred, but not limited thereto, for the datos, grooves, cuts, cut-outs, and/or indentations made in a present invention supporting beam to be parallel to its top edge, and it is also contemplated that such structure/detail in the supporting beam could be at any angle, length, or width, and having variations in depth dimension. Also, removal of the minimum amount of wood from the supporting beam by automated-feed equipment can be precisely controlled, which would optimize the strength of the beam and the structural interface with which it is used.

The description herein provides preferred embodiments of the present invention but should not be construed as limiting its scope. For example, variations in the complexity, length, width, depth, and shape of the structure/detail made in the supporting beam; whether one or more sides/edges of a supporting beam receives structure/detail; whether the structure/detail used on the same or opposing sides/edges of an engineered wood beam framing component have the same or different configurations; the perimeter configuration of a hanger's top edge during use (whether substantially straight, angled/bent, folded, or shaped); whether a rib (welded or otherwise) is formed in the back of a hanger for insertion into structure/detail of a present invention supporting beam and the top portion of the present invention hanger continues up the supporting beam for attachment to the supporting beam in a position above the structure/detail; whether the rib comprises the same or different material from the remaining portion of the hanger; and the size, number, internal configuration, and spaced-apart positioning of the pre-formed indentations employed one each side/edge of a framing component, other than those shown and described herein, may be incorporated into the present invention. Thus, the scope of the present invention should be determined by the appended claims and their legal equivalents, rather than being limited to the examples given.

DETAILED DESCRIPTION OF PREFERRED EMBODIMENTS

Figure 1:
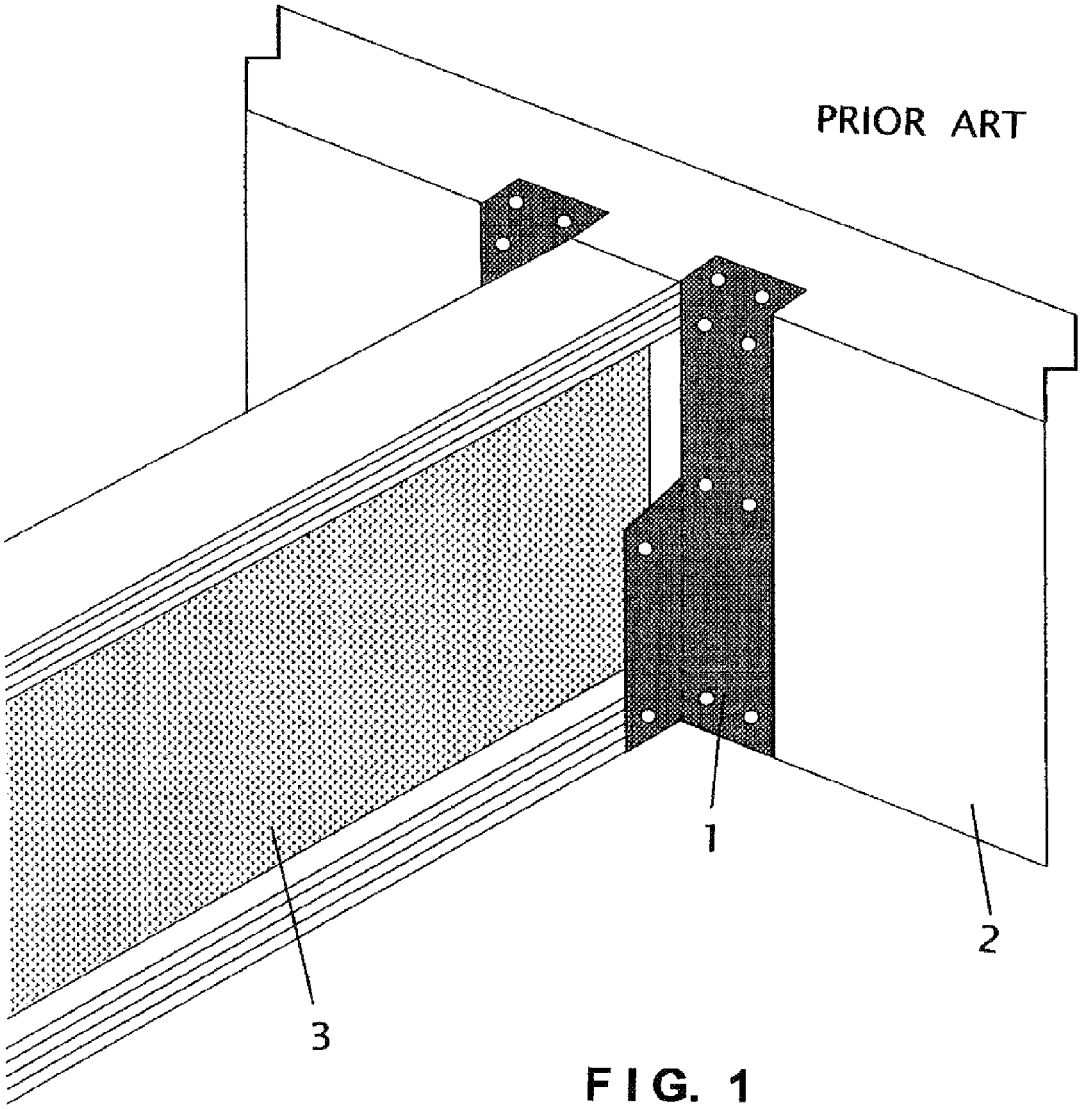
FIG. 1 is a perspective view showing the connection of two framing components in a structural interface via a top-mounted prior art hanger having a plurality of fastener holes intended for use in attachment of the hanger to both framing components, including the top surface of the supporting beam.
Figure 2:
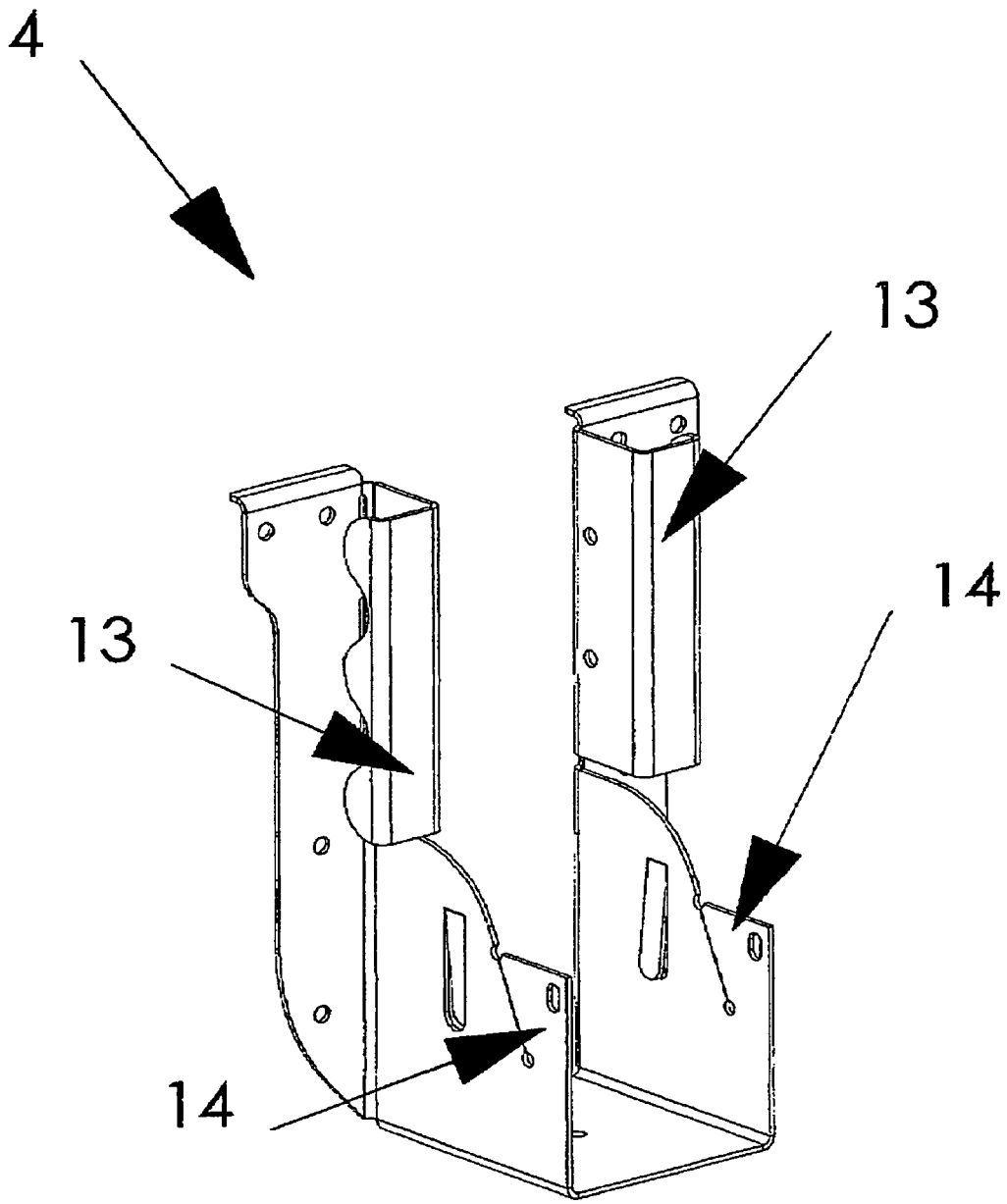
FIG. 2 is a perspective view of a preferred embodiment of present invention hanger having opposed bendable web stiffening components shown in an open position for easy lowering of a joist/rafter into its bridge, wherein after the joist/rafter becomes seated within the bridge, the bendable web stiffening components are moved against the web of a joist/rafter to stiffen it against the possibility of any potential rotation relative to the supporting beam, with the hanger also having lower structure that wraps around and can be otherwise connected to the flange/base of the joist/rafter.
Figure 3:
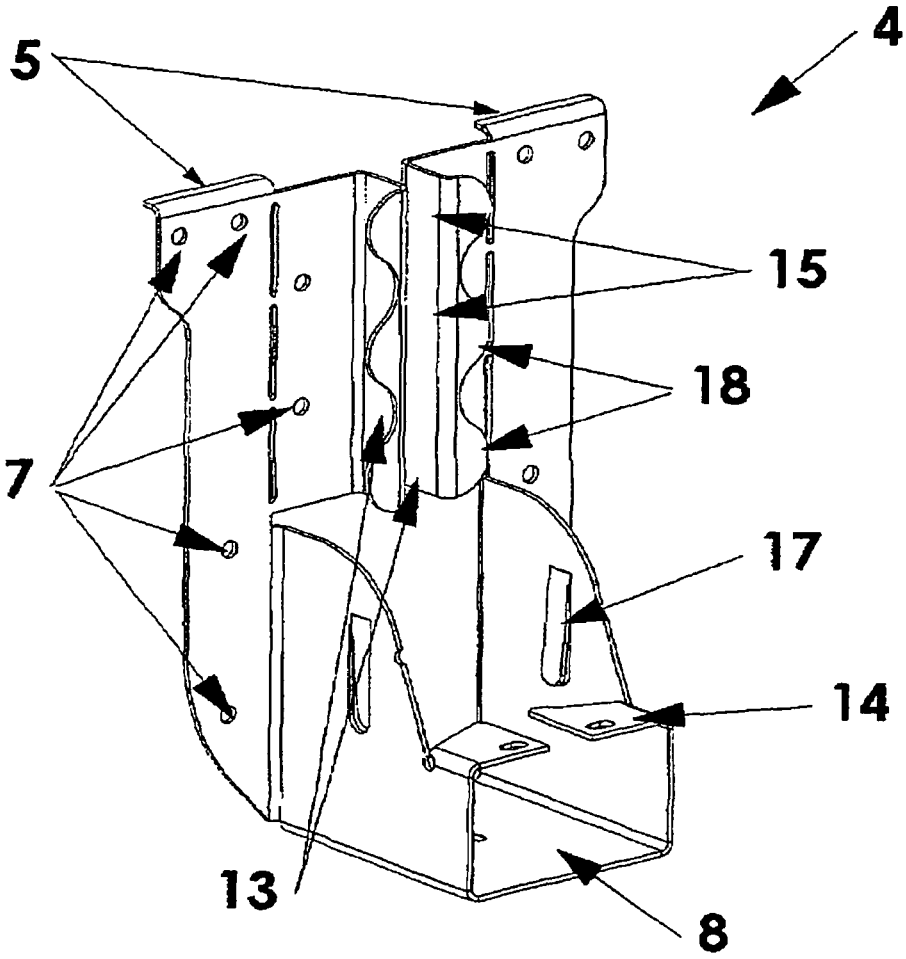
FIG. 3 is a perspective view of the hanger shown in FIG. 19 with its opposed bendable web stiffening components moved toward one another in a closed position that can be used to stiffen the web of a joist/rafter seated in its bridge, and the hanger's lower structure also shown being bent inwardly as it might appear for connection to the flange/base after a joist/rafter becomes seated in its bridge.
Figure 4:
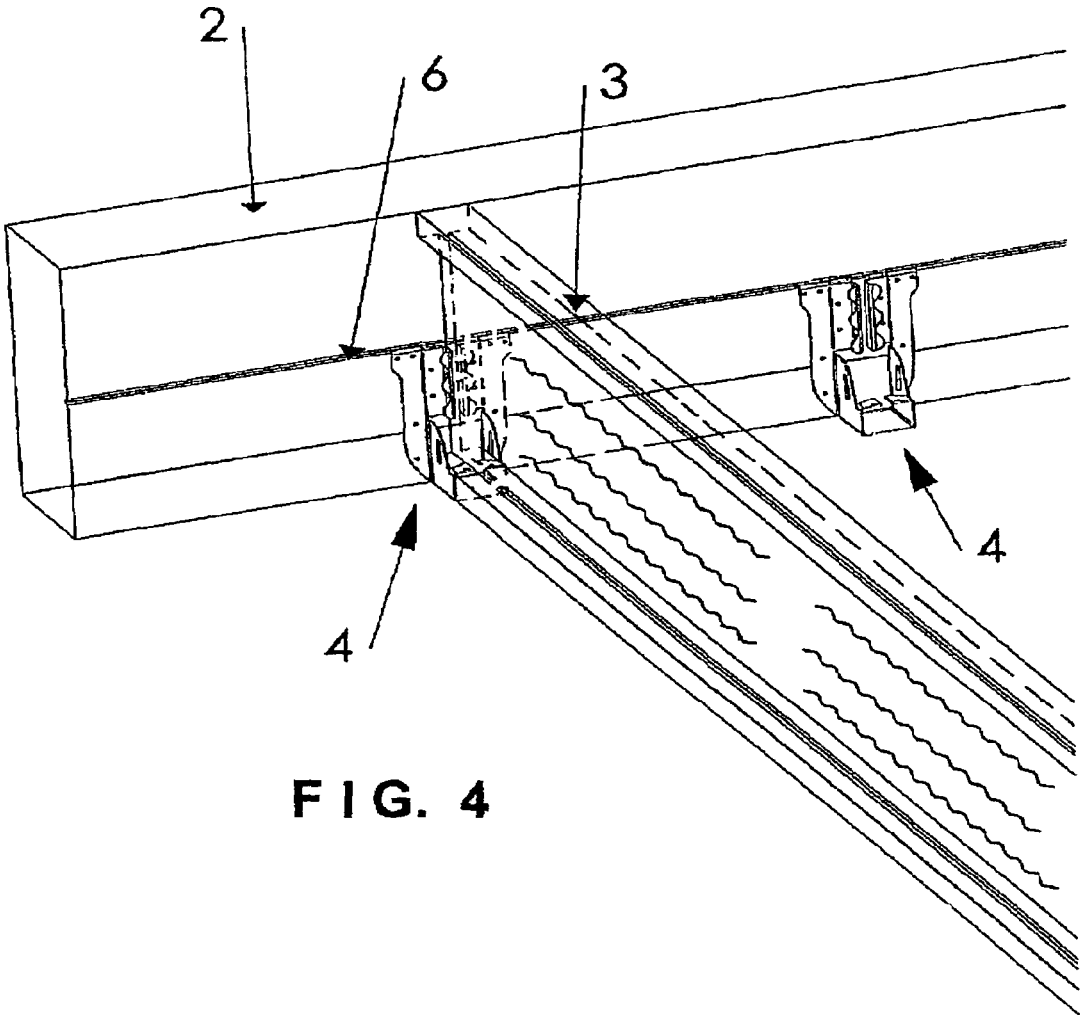
FIG. 4 is a perspective view of two present invention hangers shown in FIGS. 2 and 3 attached to a supporting beam near one of its ends, and one hanger supporting one of the opposed ends of an engineered wood joist/rafter, with the joist/rafter being shown in transparent form to reveal its positioning relative to the hanger that otherwise would only be partially visible behind it and further with hidden portions of the hanger and supporting beam marked in broken lines, and the wavy lines marked on the web of the joist/rafter being used to better distinguish it from other illustration content.

The present invention comprises a system and method intended for use in the residential and commercial construction of floors, ceilings, and roofs, and it provides structure/detail in the form of dato, grooves, cuts, cut-outs, and/or indentations 6 (hereinafter referred to as "indentations 6" without any intent of limitation) created by automated-feed equipment on at least one side/edge of framing components (such as supporting beam 2) during its manufacture, milling, and/or cutting to size at an off-site location prior to delivery to a worksite. The indentations 6 are configured for use with hangers that are preferably metal or plastic (such as the preferred present invention hangers 4 shown in FIGS. 2-8) in a structural interface (between supporting beam 2 and a supported joist/rafter 3) to provide the structural interface with significantly increased strength beyond that achievable by simply nailing hanger 4 to supporting beam 2. During its use to support hangers 4, the at least one pre-formed indentation 6 (see FIG. 4) in each supporting beam 2 may receive one or more portions of hanger 4 (such as its bent or shaped top edge 5 as shown in FIGS. 2 and 3), such that an interlocking arrangement is created between hanger 4 and supporting beam 2 that imparts superior strength with less material cost than would needed by prior art hangers (such as but not limited to the hanger 1 shown in FIG. 1) to meet the same weight transfer/load requirement. This interlocking arrangement also prevents any part of hanger 4 from having contact with the top surface of the supporting beam 2 (as shown in FIG. 4), which can be a source of noise if sheathing becomes attached over the top surfaces of supporting beam 2 and a supported joist/rafter 3, as previously discussed in the background portion of the disclosure herein. Although not limited thereto, present invention beams 2 may include Glulam beams and those comprising LVL (laminated veneer lumber), PSL (parallel strand lumber), and LSL (laminated strand lumber), as well as solid sawn lumber. The cost of creating the interlocking arrangement between hangers 4 and supporting beam 2 in the present invention, and also perhaps between hangers 4 and a portion of supported joist/rafter 3, is small when compared to the benefits provided. Furthermore, the complementary configuration in the pre-formed indentations 6 made in a supporting beam 2 for bent or shaped top edge 5 of the adjoining hanger 4 can comprise a wide variety of patterns, widths, lengths, depths, thicknesses, and locations. Removal of the minimum amount of wood from supporting beam 2 is preferred in almost all present invention applications to provide optimum supporting beam 2 strength. FIG. 1 shows use of a prior art connector 1 in a structural interface, with its top end connected over the top surface/edge of the supporting beam 2 to which it is secured via fasteners (not shown). In contrast, FIGS. 2-8 respectively show various present invention hangers 4 with bendable stiffeners 13 that are employed in both open and closed positions of use, with FIG. 4 showing two hangers 4 in contemplated positions of use in load-bearing structural interfaces, one between a supporting beam 2 and a supported joist/rafter 3, with each hanger 4 having its opposed bendable stiffeners 13 moved toward one another to create the position of use employed for strengthening a load-bearing structural interface (not given a number in the accompanying illustrations). FIGS. 2-4 also show the hanger 4 having a rearwardly-extending projection 5 configured for insertion within a horizontally-extending pre-formed indentation 6 in supporting beam 2.

FIG. 1 shows use of a top-mounted prior art connector 1 in a structural interface comprising two framing components (supporting beam 2 and supported joist/rafter 3), with the top portion of prior art connector 1 resting against the top surface/edge of supporting beam 2. However, the portion of prior art connector 1 resting against the top surface/edge of supporting beam 2 as well as the fasteners (not shown) used to secure prior art hanger 1 to the top surface/edge of supporting beam 2, all become positioned so that they are in contact with sheathing (not shown) secured over supporting beams 2 and their supported joists/rafters 3, and likely to cause unwanted noise in the finished construction as a result of weight/load transfer across the sheathing. Face-mounted prior art hangers (not shown) also have the disadvantage of becoming loosened as a result of weight/load transfer across sheathing attached to supporting beams 2 and their supported joists/rafters 3, which is the reverse of the situation relating to the present invention system and method wherein weight/load transfer across joists/rafters 3 that are secured via a portion of hangers 4 having inserted engagement with at least one pre-formed indentation 6 causes the inserted engagement to become even more secure.

Figure 5:
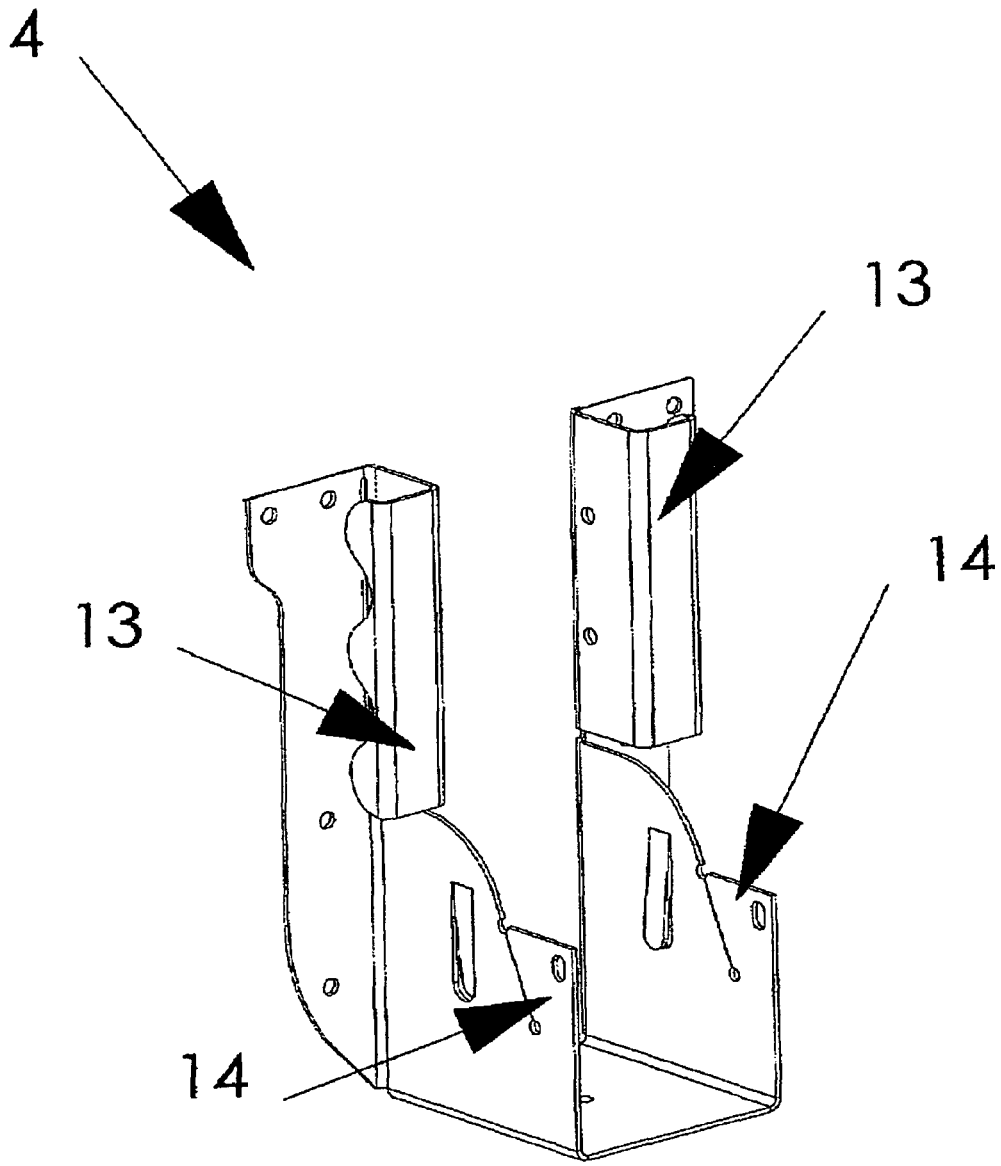
FIG. 5 is a perspective view of a preferred embodiment of present invention hanger nearly identical to that shown in FIG. 2, except that the hanger in FIG. 5 does not have the rearwardly-extending top projections.

FIG. 2 is a perspective view of a preferred embodiment of present invention bendable/stiffening hanger 4 having opposed bendable web stiffener components 13 in an open position, which later are later moved toward one another to become closed around the web of a joist/rafter 3 after it becomes seated in the hanger's bridge (marked in FIG. 3 by the number 8), with the hanger 4 also having the upper part 14 of the sides of bridge 8 that are bendable so they can wrap around and/or otherwise be connected to the flange/base of the joist/rafter 3. FIG. 3 is a perspective view of the preferred embodiment of present invention hanger 4 shown in FIG. 2 with its bendable web stiffener components 13 and the upper part 14 of the sides of bridge 8 in their closed positions, as they might appear after an engineered wood joist/rafter 3 was lowered into and seated upon bridge 8. If the upper part 14 of the sides of bridge 8 close over the top surface of the lower flange/base of a supported joist/rafter 3, the web stiffener components 13 in their closed positions would have no contact with the lower flange/base of the supported joist/rafter 3. FIG. 3 is also marked to show the two small rearwardly-extending and shaped top flanges 5 in hanger 4 that are configured for placement within an indentation/cut-out/cut/dato/groove 6 (see FIG. 4) in a supporting beam 2 having a complementary configuration, and several fastener holes 7 that can also be used to secure hanger 4 to the supporting beam 2. A fastener hole 7 is also shown within bridge 8, for use in securing the seated flange of joist/rafter 3 to bridge 8. Only the unnumbered holes in the upper part 14 of the sides of bridge 8 would be secured to the flange/base of supported joist/rafter 3, and bendable web stiffener components 13 not in contact with the lower flange/base of joist/rafter 3. In addition, FIG. 3 shows the gap 15 between bendable stiffeners 13 that is used to closely contain the web of a joist/rafter 3 seated in hanger 4, with the rounded tap points 18 on bendable stiffeners 13 assisting in the bending of stiffeners 13 by a framer. FIG. 3 also shows the cut-out side pieces 17 that are inwardly biased toward and maintain contact with opposing sides of a joist/rafter 3 comprising solid sawn lumber, to more securely hold it in its intended position of use. Furthermore, the upper part 14 of the sides of bridge 8 on hanger 4 and the inwardly-biased cut side pieces 17 are optional features of a present invention hanger 4, with each such feature being found in the prior art and not considered critical to the present invention. In addition, although it is contemplated for fastener connection to almost always be required for present invention hangers 4 used in residential and commercial construction, prior art hangers in structural interfaces are commonly secured with fasteners, and therefore the supporting beam 2 with its at least one longitudinal cut/indentation 6, in combination with present invention hangers 4 having a rearwardly-extending projection flange or top edge 5, and/or opposing bendable stiffeners 13 are considered the patentable aspect of the present invention disclosed herein. FIG. 5 is a perspective view of a preferred embodiment of present invention hanger 4 nearly identical to that shown in FIG. 2, except that the hanger 4 in FIG. 5 does not have the rearwardly-extending top projections 5.

It is contemplated for the arrangement of beams 2, joists/rafters 3. and hangers 4 shown in FIG. 4 to represent structure to which sheathing is applied, and which will be used in the commercial or residential construction of a floor, ceiling, or roof. FIG. 4 is a perspective view of two present invention hangers 4 shown in FIGS. 2 and 3 attached to a supporting beam 2 near one end of supporting beam 2, and one hanger 4 supporting one end of an engineered wood joist/rafter 3, with the joist/rafter 3 shown being in transparent form to reveal its positioning relative to the hanger 4 that otherwise would only be partially visible behind it. Furthermore, hidden portions of the hanger 4 and supporting beam 2 marked in broken lines, and the wavy lines marked on the web of the joist/rafter 3 are used to better distinguish it from other illustration content.

Figure 6:
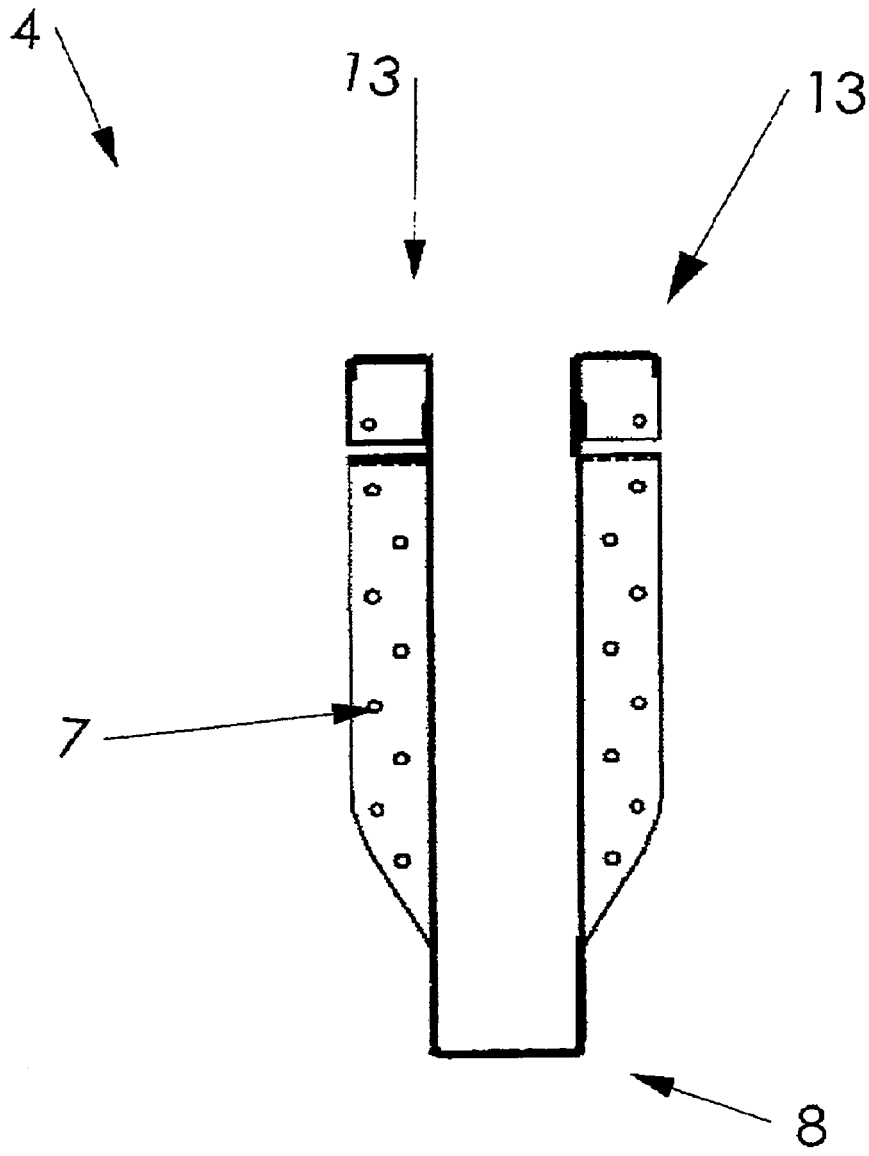
FIG. 6 is a perspective view of a preferred embodiment of present invention hanger similar to that shown in FIG. 2, except its bendable stiffeners are at the top in an out-of-the-way position that allows seating of the flange of an I-shaped joist within the hanger's bridge.
Figure 7:
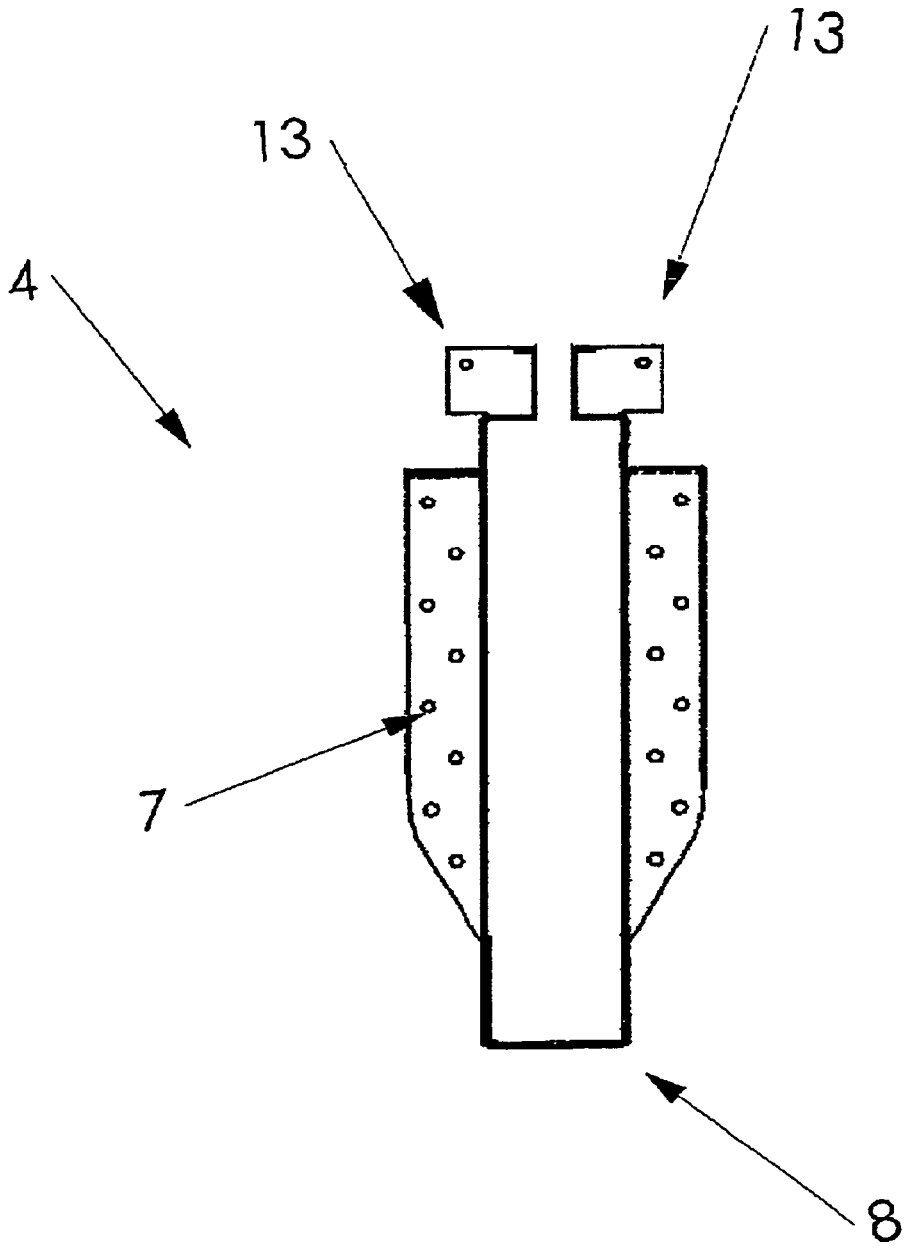
FIG. 7 is a perspective view of the preferred embodiment of present invention shown in FIG. 6 with its bendable stiffeners in positioning that allows reduced rotation of the web of an I-shaped joist having one of its flanges seated in the hanger's bridge.
Figure 8:
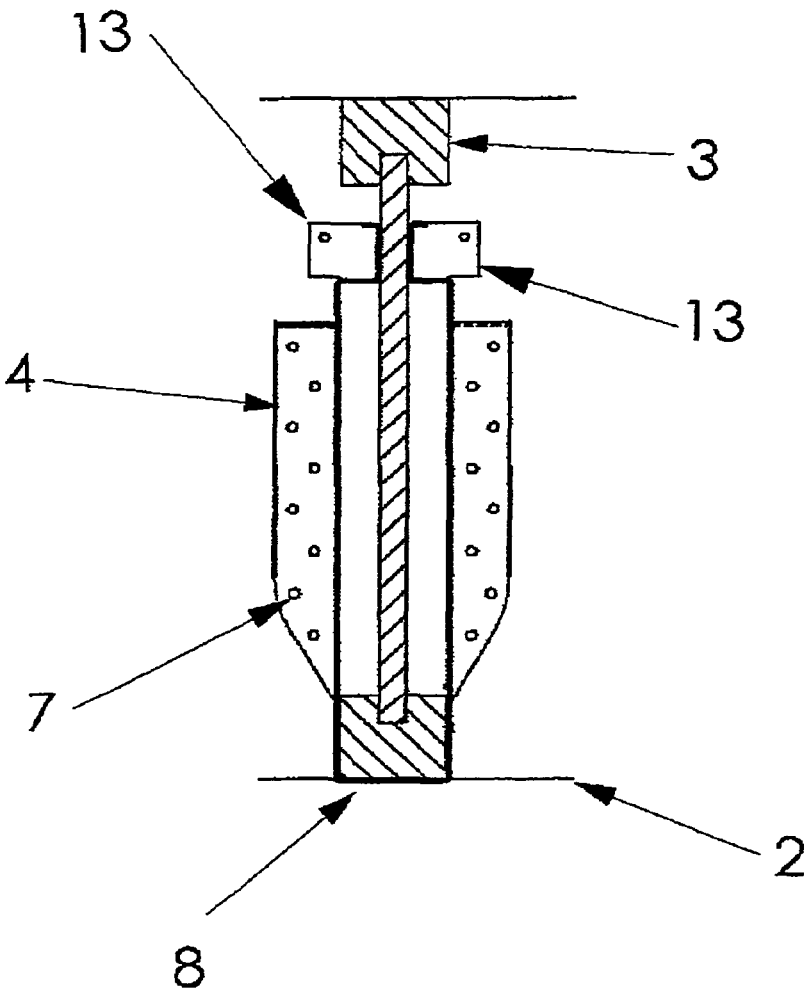
FIG. 8 is a perspective view of the preferred embodiment of present invention hanger in the positioning shown in FIG. 7, with the addition of an I-shaped joist that shows the web stiffeners in contact with the web of the I-shaped joist.

FIGS. 6-8 show a preferred embodiment of present invention hanger similar to that shown in FIGS. 2, 3, and 5, with FIG. 6 being a perspective view of a preferred embodiment of present invention hanger similar to that shown in FIG. 2, except its bendable stiffeners are at the top in an out-of-the-way position that allows seating of the flange of an I-shaped joist within the hanger's bridge. In contrast, FIG. 7 shows its bendable stiffeners in positioning that reduces rotation of the web of an I-shaped joist having one of its flanges seated in the hanger's bridge, and FIG. 8 has an I-shaped joist to show the relation of web stiffeners to web of the joist.

I claim:

1. A structural interface strengthening system used mainly in residential and commercial construction of floors in a structural interface between a support beam and an engineered wood I-shaped joist having a thin central web and opposing top and bottom flanges each having a width dimension larger than that of said web, said structural interface strengthening system comprising:

a support beam;

an engineered wood I-shaped joist having a thin central web and opposing top and bottom flanges each with a width dimension larger than that of said web; and a quantity of rigid hanger material having a lower portion configured as a bridge that closely receives and supports said bottom flange of said engineered wood I-shaped joist, said quantity of hanger material also having an upper portion configured with opposed stiffener components bendable toward one another, wherein when said engineered wood I-shaped joist is supported by said bridge and said upper portion of said rigid hanger material is secured to said support beam, and said bendable stiffener components are rotated toward one another, closely and directly engaging and securing said thin web of said I-shaped joist without having contact with said bottom flange thereof, rotation of said engineered wood I-shaped joist relative to said support beam is reduced during weight transfer across said structural interface created by connection of said support beam, said engineered wood I-shaped joist, and said quantity of rigid hanger material, providing a strong structural interface with less material cost, environmental benefit, and reduced noise in finished construction.

2. The system of claim 1 wherein said upper portion of said quantity of rigid hanger material further comprises at least one fastening hole.

3. The system of claim 1 wherein said quantity of rigid hanger material is pre-scored, facilitating rotation of said bendable stiffener components toward one another.

4. The system of claim 1 wherein said bendable stiffener components are further adapted to center said I-shaped joist against said support beam.

5. The system of claim 1 wherein at least one said bendable stiffener component further comprises least one reinforced edge.

6. The system of claim 1 wherein at least one said bendable stiffening component further comprises at least one tap point.

7. The system of claim 1 wherein said upper portion of said quantity of rigid hanger material further comprises at least two rearwardly-extending projections and said support beam comprises at least one indentation configured for interlocking engagement with said at least two projections, further strengthening said structural interface when such interlocking engagement between said rigid hanger material and said support beam occurs.

8. The system of claim 7 wherein said upper portion of said quantity of rigid hanger material further comprises a top end and wherein said at least two rearwardly-extending projections depend from said top end.

9. The system of claim 1 wherein said lower portion of said quantity of rigid hanger material further comprises at least one fastening hole through said bridge.

10. The hanger of claim 1 further comprising at least one fastening hole through said bridge and wherein said upper portion further comprises at least one fastening hole.

11. A system for providing a strong load-bearing structural interface in residential and commercial construction of floors using sheathing secured over support beams and supported joists connected to one another by hangers, said system comprising:

at least two support beams;

a plurality of engineered wood I-shaped joists each with a thin central web and opposing top and bottom flanges each having a width dimension larger than that of said web, said engineered wood I-shaped joists also each having opposite ends and said web having opposing sides; and a plurality of hangers each having a bridge configured for receiving and supporting one of said bottom flanges, said hangers also each having at least two bendable stiffener components positioned above said bridge and configured to create pinching contact with said opposing sides of said web after rotation of said stiffer components tower one another occurs, closely and directly engaging and securing said thin web of said I-shaped joist without having contact with said bottom flange thereof, reducing rotation of said engineered wood I-shaped joist when seated in said bridge, wherein when a different one of said hangers is secured to each of said opposite ends of each said engineered wood I-shaped joist, and each said hanger on one of said opposite ends of said I-shaped joist is also securely fixed to a different one of said least two support beams, rotation of each said engineered wood I-shaped joist relative to the ones of said support beams connected thereto is reduced after sheathing is applied, strengthening the structural interfaces between said engineered wood I-shaped joists and said support beams with less material cost, reduced installation time, and reduced noise in the finished construction.

12. The system of claim 11 wherein at least one said bendable stiffener component comprises at least one fastening hole.

13. The system of claim 11 wherein at least one said hanger is pre-scored, facilitating rotation of said bendable stiffener components.

14. The system of claim 11 wherein said bendable stiffener components are further adapted to center said I-shaped joist against said support beam.

15. The system of claim 11 wherein at least one said bendable stiffening component is further adapted with at least one reinforced edge.

16. The system of claim 11 wherein at least one said bendable stiffener component is further adapted with at least one tap point.

17. The system of claim 11 wherein at least one said hanger further comprises at least one rearwardly-extending projection and at least one said support beam comprises at least one indentation configured for interlocking engagement with said at least one rearwardly-extending projection, further strengthening said structural interface when such interlocking engagement between said rigid hanger material and said support beam occurs.

18. The system of claim 17 wherein said at least one hanger has a top end and wherein said at least one rearwardly-extending projection depends from said top end.

19. The system of claim 11 further comprising at least one fastening hole through said bridge.

20. The hanger of claim 11 further comprising at least one fastening hole through said bridge and at least one fastening hole not through said bridge.

* * * * *